US005095640A

United States Patent [19]

Mohr

[11] Patent Number: 5,095,640

[45] Date of Patent: Mar. 17, 1992

[54] METHOD OF PRODUCING BUCKET WHEEL BODIES AND BUCKET WHEEL BODY PRODUCED BY THE METHOD

[75] Inventor: Helmut Mohr, Duisburg, Fed. Rep. of Germany

[73] Assignee: O&K Orenstein & Koppel Aktiengesellschaft, Dortmund, Fed. Rep. of Germany

[21] Appl. No.: 466,382

[22] PCT Filed: Apr. 21, 1989

[86] PCT No.: PCT/EP89/00430

§ 371 Date: Oct. 29, 1990

§ 102(e) Date: Oct. 29, 1990

[87] PCT Pub. No.: WO88/09306

PCT Pub. Date: Dec. 1, 1988

[30] Foreign Application Priority Data

May 6, 1988 [DE] Fed. Rep. of Germany ..... 3815490
Nov. 21, 1988 [DE] Fed. Rep. of Germany ..... 3839274

[51] Int. Cl.[5] ..... E02F 3/18

[52] U.S. Cl. ..... 37/189; 37/195; 172/604; 29/894; 29/894.361

[58] Field of Search ..... 37/189, 190, 70, 91, 37/195; 172/555, 556, 604; 29/894, 894.36, 894.361, 894.362

[56] References Cited

U.S. PATENT DOCUMENTS

| | | | |
|---|---|---|---|
| 1,965,203 | 7/1934 | Sinclair | 29/894.361 X |
| 2,007,811 | 7/1935 | Orelind | 29/894.361 X |
| 2,086,488 | 7/1937 | Batie | 29/894 X |
| 2,700,235 | 1/1955 | Kolbe | 37/190 |
| 3,260,345 | 7/1966 | Scholler | 37/190 X |
| 3,683,522 | 8/1972 | Rousseau et al. | 37/189 X |
| 3,747,380 | 7/1973 | Frizzell et al. | 72/21 |
| 3,871,118 | 3/1975 | Brech | 37/189 |
| 4,780,972 | 11/1988 | Keene | 37/189 X |

FOREIGN PATENT DOCUMENTS

| | | | |
|---|---|---|---|
| 5075/61 | 5/1963 | Australia . | |
| 5076/61 | 5/1963 | Australia . | |
| 16609/76 | 8/1976 | Australia . | |
| 390871 | 10/1932 | Belgium . | |
| 763672 | 3/1954 | Fed. Rep. of Germany | 37/189 |
| 1149683 | 6/1963 | Fed. Rep. of Germany . | |
| 1402836 | 1/1969 | Fed. Rep. of Germany . | |
| 1452614 | 3/1969 | Fed. Rep. of Germany . | |
| 2314241 | 4/1980 | Fed. Rep. of Germany . | |
| 730783 | 8/1932 | France . | |
| 1111110 | 2/1956 | France . | |
| 2384564 | 10/1978 | France | 29/894.361 |
| 422819 | 9/1974 | U.S.S.R. | 37/189 |
| 832431 | 4/1960 | United Kingdom | 172/604 |

OTHER PUBLICATIONS

Becker et al., "Umformen dicker Bleche" [Shaping of Thick Sheets], *Werkstatt und Betrieb,* vol. 112, No. 10, 1979, p. 714.

Zemann "Einfluss von Blechdickentoleranz und Werkzeugeinstellung auf das Ziehergebnis bei der Herstellung von Radscheiben" [The Influence of Sheet Thickness Tolerances and Tool Settings on Drawability in the Production of Wheel Discs], in *Fertigungstechnik und Betrieb,* vol. 26, No. 5, 1976, pp. 282–284.

*Primary Examiner*—Randolph A. Reese
*Assistant Examiner*—Arlen L. Olsen
*Attorney, Agent, or Firm*—Spencer & Frank

[57] ABSTRACT

A bucket wheel body includes a supporting body having a frustoconical region, a radially outer circumferential region, and a radially inner circumferential region. The frustoconical region forms a carrier body; the radially outer region forms a rounded annular carrier for supporting buckets and the radially inner region forms a rounded hub support. The hub support, the annular carrier and the carrier body form a one-piece construction and jointly define an S-shaped cross section. A disc-shaped hub body is attached to the hub support. The hub body has an outer circumferential edge and a central opening. The outer circumferential edge of the hub body is in engagement with the carrier body, and a terminal edge face of the hub support is in engagement with the hub body along a zone radially inwardly of the outer circumferential edge of the hub body.

8 Claims, 1 Drawing Sheet

METHOD OF PRODUCING BUCKET WHEEL BODIES AND BUCKET WHEEL BODY PRODUCED BY THE METHOD

BACKGROUND OF THE INVENTION

The invention relates to a method of producing a bucket wheel body having a supporting body formed of a single sheet of metal with an approximately frustoconical cross section, particularly for use in open pit mining.

Federal Republic of Germany Patent 2,314,241 discloses a bucket wheel without cells having a conical supporting body which is rotatably mounted on the bucket wheel shaft and to which is fastened an annular body supporting the buckets. The supporting body is composed of a disc which can be produced by rolling in one process step. The essential drawbacks of this type of shaping are that outlines can be produced only in one direction, starting from the center of the bucket wheel so that, in order to provide the necessary stability, a number of welding procedures (application of reinforcements or the like) must be performed. This measure increases the overall weight of the bucket wheel body. Another drawback is the likewise expensive mounting of the buckets at the outer periphery of the bucket wheel body which must also be produced by welding.

Even if the basic body can already be produced in one process step, the still required work must be considered to be time and cost intensive, with welding work at the annular carrier and at the supports being difficultly accessible once the bucket wheel is completed. This produces problems during necessary repair measures so that the bucket wheel excavator must be shut down for a longer period of time.

SUMMARY OF THE INVENTION

It is the object of the invention to design a method of producing a bucket wheel body with which the expensive welding work can be reduced to a minimum without thereby adversely influencing the rigidity of the bucket wheel body. Moreover, a bucket wheel body is to be designed which can be produced easily and economically, with the still required welding work for possible repair purposes being better accessible.

This is accomplished with respect to the method in that the supporting body is shaped by deep drawing or hammering of the sheet metal; that an annular carrier to accommodate the buckets is shaped to the supporting body in its radially outer circumferential region when seen in the radial direction.

With the measures according to the invention, it is possible to produce a finished blank composed of the frustoconical supporting body and at least the shaped-on annular carrier. Welding work for shaping on the annular carrier can be avoided entirely. Compared to the prior art, a bucket wheel body is presented here which is not only significantly easier to manufacture but, moreover, lighter in weight and thus more economical.

Advantageous modifications of the features of the method according to the invention are described below.

A bucket wheel body having a conical supporting body is characterized in that supporting body, annular carrier and hub support are made in one piece. Advantageous features of the bucket wheel body according to the invention are set forth below.

Due to the geometrical shape of the bucket wheel body (S shape), the hub body which is configured as a disc having a central passage bore, can be connected without problems, with the outgoing region of the hub support and with the frustoconical region of the supporting body. Further supporting elements, as they are required in the prior art devices for reasons of rigidity, are not needed here.

The bucket wheel body can be produced by cold as well as hot shaping. The selection of the shaping process is here dependent on the respective size or power of the open pit mining equipment.

As already mentioned, the manufacturing process (rolling) employed in the prior art is able to produce only the frustoconical outline of the supporting body. The method steps according to the invention permit the problem-free shaping of radii required for further processing so that the welding work required at these locations in the past can be omitted entirely. The further construction of the bucket wheel body can be in modular form in that the carriers to accommodate the buckets are welded directly into the free space of the annular carrier or a circumferential flange is connected with the annular carrier into which the carriers are then screwed. In order to increase the stability of the bucket wheel body, a circumferential disc or an outwardly open U-profile may also be screwed or welded to the free end of the carriers.

BRIEF DESCRIPTION OF THE DRAWINGS

FIG. 1 is a schematic sectional axial view of the structure of the bucket wheel body 1 according to the invention. Bucket wheel body 1 includes the following components: a frustoconical carrier body 2, an annular carrier 3 following in the radially outer circumferential region as well as a hub support 4 shaped to the radially inner circumferential region. Carrier body 2, annular carrier 3 and hub support 4 here have an S-shaped cross section, with this profile having been produced by hammering a metal sheet. In the region of the rounded annular carrier 3, i.e. at its open portion 5, there is provided a horizontally extending reinforcement 6. Between an outgoing end 7 of annular carrier 3 and a free end 8 of reinforcement 6, a circumferential flange 9 is welded on which serves as a mount (screw connection) for carriers 10 which accommodate the buckets (not shown in detail). In order to make the entire system more rigid, components 21 having a U-shaped cross section are screwed to free ends 11 of carriers 10 so as to form a circumferential component. In the radially inner circumferential region of supporting body 2 there is also provided a rounded portion which constitutes the so-called hub support 4. A hub 12 itself is configured as a disc having a central passage bore 13. Hub 12 and hub support 4 are connected with one another in such a way that a free end 14 of hub support 4 above passage bore 13 is supported at hub 12 and a radially outer circumferential region 15 of hub 12 is supported at the frustoconical supporting body 2, with the respective points of contact being welded together.

FIG. 2 is a partial view of bucket wheel body 1. Shown is the region of hub support 4 as well as hub 12.

Figure 1:
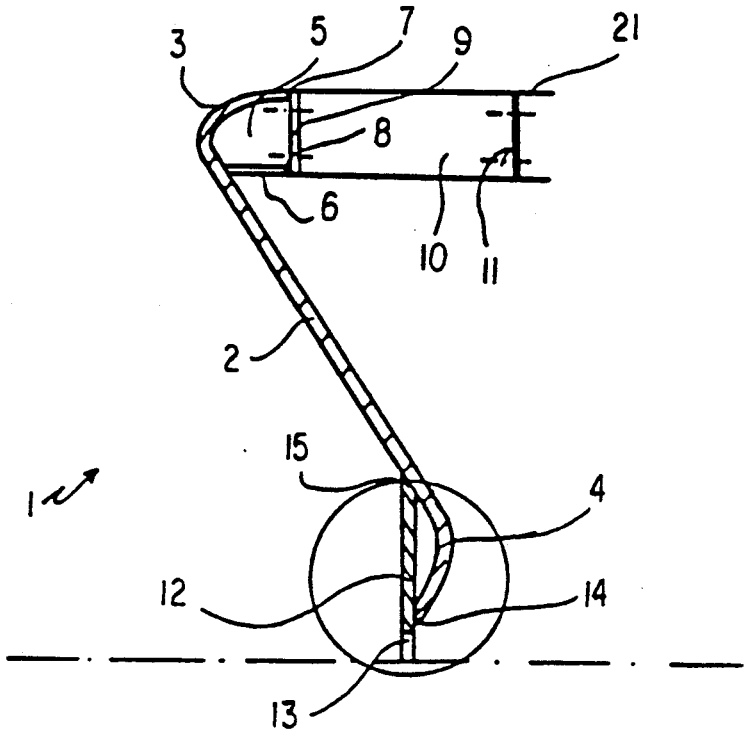
FIG. 1 is a sectional axial view of the bucket wheel body according to the invention.
Figure 2:
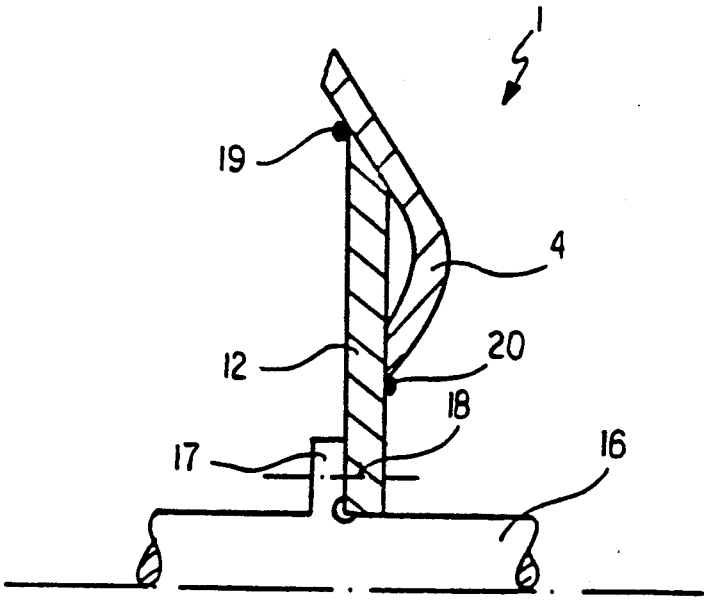
FIG. 2 is a partial view of the bucket wheel body of FIG. 1.

Hub 12 is seated on a drive shaft 16 which has a radial abutment 17 and is connected with hub 12 by means of a screw connection 18. Hub 12 and hub support 4 are connected with one another by welding in the region of points of contact 19, 20.

We claim:

1. A method of producing a bucket wheel body, comprising the following steps:

(a) deep drawing, from a single metal sheet, a supporting body; said deep drawing step including:

(i) forming a frustoconical carrier body having a radially outer circumference and a radially inner circumference;

(ii) forming, at said radially outer circumference, an annular carrier for accommodating a plurality of buckets; and (iii) forming, at said radially inner circumference, a rounded zone constituting a hub support having a terminal edge face; said carrier body, said annular carrier and said hub support together forming said supporting body; and (b) attaching to the hub support a disc-shaped tub body such that an outer circumferential edge of the hub body is in engagement with the frustoconical carrier body, and the terminal edge face of the hub support is in engagement with the hub body along a zone radially inwardly of said outer circumferential edge of the hub body.

2. A method according to claim 1, wherein said deep drawing step is performed as a single process step.

3. A method according to claim 1, wherein said step of deep drawing the supporting body comprises shaping the supporting body to have a substantially S-shaped cross section.

4. A method according to claim 3, further comprising the step of welding a bucket-receiving circumferential flange to said annular carrier for accommodating buckets circumferentially distributed about the carrier body.

5. A bucket wheel body comprising:

a supporting body having a frustoconical region, a radially outer circumferential region, and a radially inner circumferential region;

said frustoconical region forming a carrier body;

said radially outer region forming a rounded annular carrier for supporting buckets;

said hub support, said annular carrier, and said carrier body jointly defining an S-shaped cross section and being a one-piece construction; and a disc-shaped hub body attached to said hub support; said hub body having an outer circumferential edge and a central opening; said outer circumferential edge of said hub body being in engagement with said carrier body, and a terminal edge face of the hub support being in engagement with said hub body along a zone radially inwardly of said outer circumferential edge of said hub body.

6. A bucket wheel body according to claim 5, further comprising a circumferential flange attached to said annular carrier.

7. A bucket wheel body according to claim 6, further comprising a plurality of uniformly circumferentially distributed supports attached to said circumferential flange for accommodating buckets.

8. A bucket wheel body according to claim 5, further comprising a plurality of uniformly circumferentially distributed supports attached to a hollow, open zone of said annular carrier for accommodating buckets.

* * * * *